US009322308B2

(12) United States Patent
Watanabe

(10) Patent No.: US 9,322,308 B2
(45) Date of Patent: Apr. 26, 2016

(54) EJECTOR

(75) Inventor: Tomohiro Watanabe, Tokyo (JP)

(73) Assignee: Koganei Corporation, Tokyo (JP)

( * ) Notice: Subject to any disclaimer, the term of this patent is extended or adjusted under 35 U.S.C. 154(b) by 0 days.

(21) Appl. No.: 14/007,799

(22) PCT Filed: Aug. 29, 2011

(86) PCT No.: PCT/JP2011/069464

§ 371 (c)(1),
(2), (4) Date: Sep. 26, 2013

(87) PCT Pub. No.: WO2012/132047

PCT Pub. Date: Oct. 4, 2012

(65) Prior Publication Data

US 2014/0014746 A1 Jan. 16, 2014

(30) Foreign Application Priority Data

Mar. 28, 2011 (JP) ..... 2011-069125

(51) Int. Cl.

| | |
|---|---|
| ***B05B 1/00*** | (2006.01) |
| ***F01N 1/00*** | (2006.01) |
| ***F04B 39/00*** | (2006.01) |
| ***F04F 5/18*** | (2006.01) |
| ***F04F 5/46*** | (2006.01) |

(52) U.S. Cl.

CPC ..... *F01N 1/003* (2013.01); *F04B 39/0061* (2013.01); *F04F 5/18* (2013.01); *F04F 5/46* (2013.01)

(58) Field of Classification Search

USPC ..... 294/183

See application file for complete search history.

(56) References Cited

U.S. PATENT DOCUMENTS

| | | | | | |
|---|---|---|---|---|---|
| 3,892,168 | A | * | 7/1975 | Grobman | 414/789.1 |
| 4,865,521 | A | * | 9/1989 | Ise et al. | 417/187 |
| 5,683,227 | A | * | 11/1997 | Nagai | F04F 5/22 417/174 |
| 6,155,796 | A | * | 12/2000 | Schmalz et al. | 417/187 |

(Continued)

FOREIGN PATENT DOCUMENTS

| | | | |
|---|---|---|---|
| CN | 201184754 | A | 1/2009 |
| JP | H09317698 | A | 12/1997 |

(Continued)

OTHER PUBLICATIONS

International search report for PCT/JP2011/069464 dated Nov. 9, 2011.

(Continued)

*Primary Examiner* — Len Tran
*Assistant Examiner* — Adam J Rogers
(74) *Attorney, Agent, or Firm* — McCormick Paulding & Huber LLP

(57) ABSTRACT

An ejector (20), which built in an ejector housing hole (18), comprises: a nozzle (21) for diffusing and ejecting compressed air from an air supply port (23); and a diffuser (22) formed with an ejection port (29) for discharging air ejected from the nozzle (21) and air flowing in from a suction port (30). A muffler main body (42) attached to an ejector block (11) is formed with a silencing chamber (43), and a distal-end wall portion (42*b*) of the muffler main body (42) is formed with an exhaust port (48) facing the ejection port (29). It is possible to achieve the silencing effect while ensuring the vacuum degree of negative-pressure air and the intake flow rate by discharging air from the exhaust port (48).

7 Claims, 10 Drawing Sheets

(56) References Cited

U.S. PATENT DOCUMENTS

| | | | | |
|---|---|---|---|---|
| 2008/0129062 | A1* | 6/2008 | Schmalz et al. | 294/64.1 |
| 2010/0045057 | A1* | 2/2010 | Tell | 294/64.1 |
| 2010/0207409 | A1 | 8/2010 | Perlman et al. | |

FOREIGN PATENT DOCUMENTS

| | | | |
|---|---|---|---|
| JP | 2003035300 | A | 2/2003 |
| JP | 2003194000 | A | 7/2003 |
| JP | 2003222100 | A | 8/2003 |
| JP | 2005262351 | A | 9/2005 |

OTHER PUBLICATIONS

Office Action received in Chinese Patent Application 201180069685.5 dated Mar. 30, 2015 and its English Translation.

* cited by examiner

EJECTOR

TECHNICAL FIELD OF THE INVENTION

The present invention relates to an ejector for generating a negative pressure at a suction port by spraying compressed air from a nozzle to a diffuser and ejecting the compressed air from an ejecting port of the diffuser, and particularly relates to an ejector provided with a muffler for reducing exhaust noise from the ejecting port.

BACKGROUND OF THE INVENTION

A vacuum generating apparatus adapted to generate a negative pressure by utilizing the flow of compressed air is referred to as "ejector". This ejector has: a nozzle for focusing the compressed air, then diffusing and ejecting the compressed air; and a diffuser coaxially aligned with the nozzle. By supplying compressed air from the nozzle to the diffuser to cause the air to flow toward an ejecting port provided in a downstream portion of the diffuser, a negative-pressure region is formed around a distal-end portion of the nozzle. If a suction port is open in this negative-pressure region, the negative pressure is generated at the suction port because of the viscosity of air.

As one example of an ejector based on this operation principle, as disclosed in Patent Document 1, an ejector attached to a pneumatic apparatus assembled with a vacuum regulator and a vacuum filter is known. The ejector of this type is adapted to supply a large amount of negative-pressure air, and has a tandem diffuser to increase the flow rate of intake air.

On the other hand, as one ejector which is used for attracting and carrying a small electronic component such as several-mm square of semiconductor chip, as disclosed in Patent Document 2, an ejector incorporated in a block is known. In the ejector of this type, a solenoid valve for vacuum generation, which controls the supply of compressed air to a nozzle of the ejector, and a solenoid valve for vacuum break, which controls the supply of compressed air for vacuum break when an electronic component is detached from an attracting tool, are assembled in the block.

In either of the ejectors of the above types, a muffler is provided so as to reduce exhaust noise caused by air discharged from an ejecting port, in other words, an exhaust port of a diffuser to the outside.

PRIOR ART DOCUMENTS

Patent Documents

Patent Document 1: Japanese Patent Application Laid-Open Publication No. 2003-194000

Patent Document 2: Japanese Patent Application Laid-Open Publication No. 2005-262351

DISCLOSURE OF THE INVENTION

Problems to be Solved by the Invention

By mounting an ejector on a vacuum attracting apparatus for attracting a small electronic component, it is possible to cause a suction port to generate a negative pressure by supplying compressed air to the ejector, and possible to detach the electronic component from an attracting tool by breaking the vacuum by compressed air. When the ejector is utilized for generating vacuum, large exhaust noise is caused by the ejector in comparison with the case in which vacuum is supplied from a vacuum pump disposed at a position away from the vacuum attracting apparatus.

Particularly, in a manifold type collectively provided with a plurality of vacuum attracting apparatuses respectively having ejectors, total exhaust noises caused by a plurality of ejecting ports are larger than exhaust noise caused by one ejector.

In a conventional ejector block incorporated with an ejector, which is often used to reduce exhaust noise caused by the ejector block, an exhaust opening formed at a lowermost stream portion of an exhaust flow channel is closed by a silencing member composed of porous material, so that a ventilation resistance is applied to the exhaust air to be discharged to the outside. However, the vacuum degree of negative-pressure air and the intake flow rate of negative-pressure air cannot be sufficiently ensured unless the volume of the exhaust air from the ejecting port is increased in the ejector; therefore, a method of applying ventilation resistance to the exhaust air has a limitation in improving the silencing effect while ensuring the vacuum degree and the intake flow rate. This is for a reason that, when the ventilation resistance of the exhaust flow channel is increased by disposing the silencing member at the exhaust opening so as to interrupt the flow of air from the ejecting port, the vacuum degree and the intake flow rate of the negative-pressure air are reduced.

So, the cause of the exhaust noise in the ejector was studied. Since the ejecting port of the diffuser in the ejector is composed of a diffusion hole, air ejected from this portion flows toward the downstream while being expanded in the radially outward direction. As a result, the noise from the ejecting port is diffused radially outward, and the noise caused by straight air at the center part of the exhaust ejection flow is conceived to be smaller than the noise caused by the diffusion air. The flow of the center part of the exhaust ejection flow does not includes many noise components, while it is believed that the vacuum degree and the intake flow rate of the generated negative-pressure air largely depend on the flow of the center part of the exhaust ejection flow. Based on this point of view, an ejector capable of reducing the exhaust noise of the ejector has been developed.

It is an object of the present invention to reduce exhaust noise from an ejector while maintaining the vacuum degree and the intake flow rate of the negative-pressure air by the ejector.

Means for Solving the Problems

An ejector according to the present invention comprises: an ejector block formed with an ejector housing hole which communicates with an air supply port at a base end thereof; a nozzle arranged on a base end side of the ejector housing hole, and adapted to focus compressed air from the air supply port, diffuse and eject the focused air; a diffuser arranged on a downstream side of the nozzle in the ejector housing hole, the diffuser being formed with an ejecting port for discharging air ejected from the nozzle and air flowed from a suction port, the diffuser and the nozzle constituting an ejector; a muffler main body having a cylindrical portion covering the ejecting port and a distal-end wall portion integrally formed with one end of the cylindrical portion, the muffler main body is formed with a silencing chamber into which air discharged from the ejecting port flows; a cylindrical silencing member arranged in the cylindrical portion; and an exhaust opening provided so as to face the ejecting port at the distal-end wall portion and coaxially aligned with the ejecting port.

In the ejector according to the present invention, a silencing gap may be formed between the silencing member and an inner circumferential surface of the cylindrical portion. In the ejector according to the present invention, the nozzle may be within the range of 0.5 to 1.0 mm in inner diameter, and the silencing member may be within the range of 20 to 50 mm in length. In the ejector according to the present invention, the nozzle may be within the range of 0.5 to 1.0 mm in inner diameter, and the exhaust opening may be within the range of two to four times of the nozzle in inner diameter.

According to the present invention, air ejected from the ejecting port of the diffuser in the ejector flows toward the downstream while being expanded radially outward, and diffusion air, which is a main element of noise generation, is silenced by the cylindrical silencing member. On the other hand, since the flow at the center part of an exhaust ejection flow having small noise generating elements is discharged from the exhaust opening to the outside, and by discharging the center airflow from the exhaust opening, the vacuum degree and the intake flow rate of the generated negative-pressure air can be sufficiently ensured. Therefore, it is possible to reduce exhaust noise from the ejector while maintaining the vacuum degree and the intake flow rate of the negative-pressure air by the ejector.

BEST MODE FOR CARRYING OUT THE INVENTION

Figure 1:
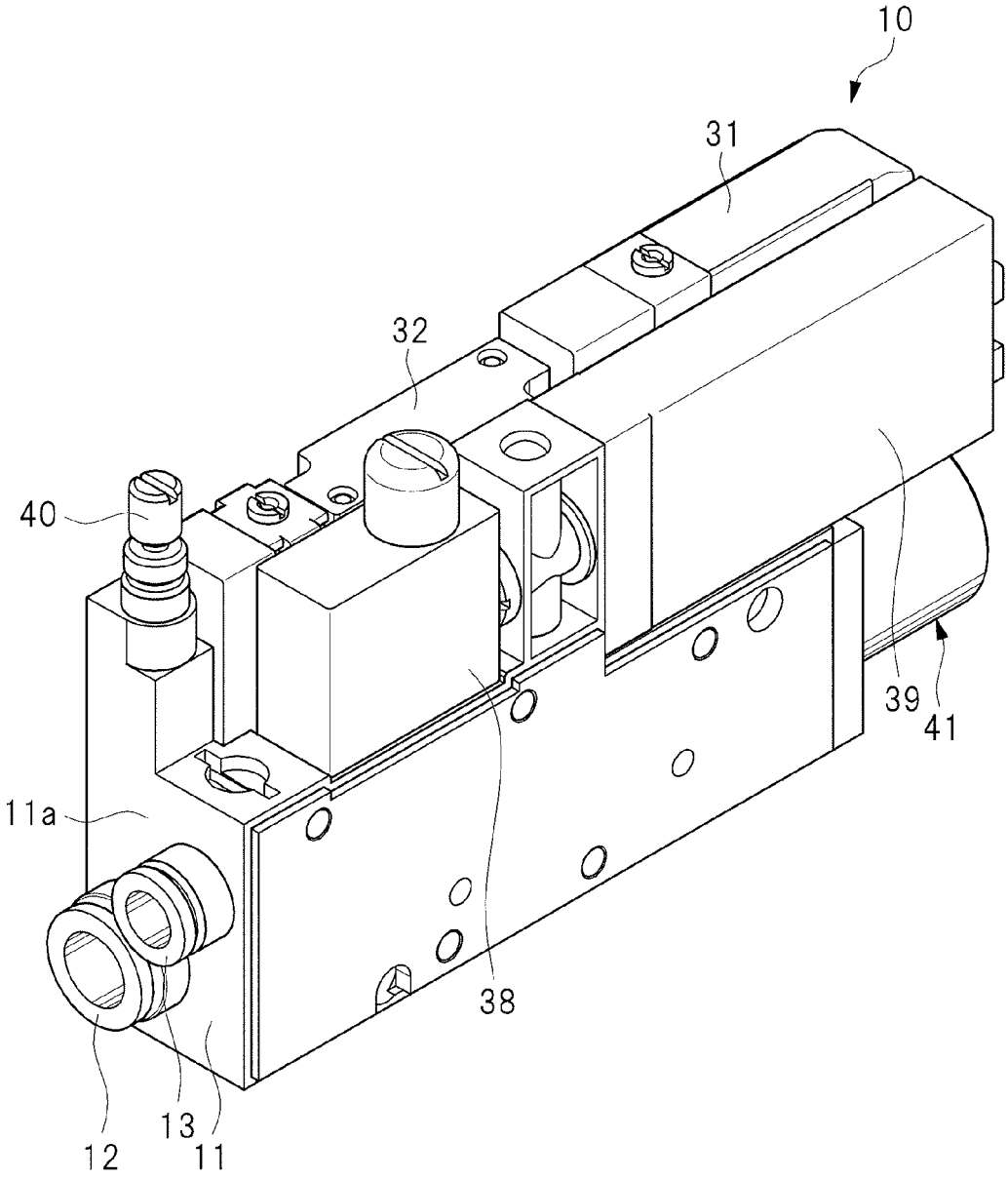
FIG. 1 is a perspective view showing an ejector according to one embodiment of the present invention.
Figure 2:
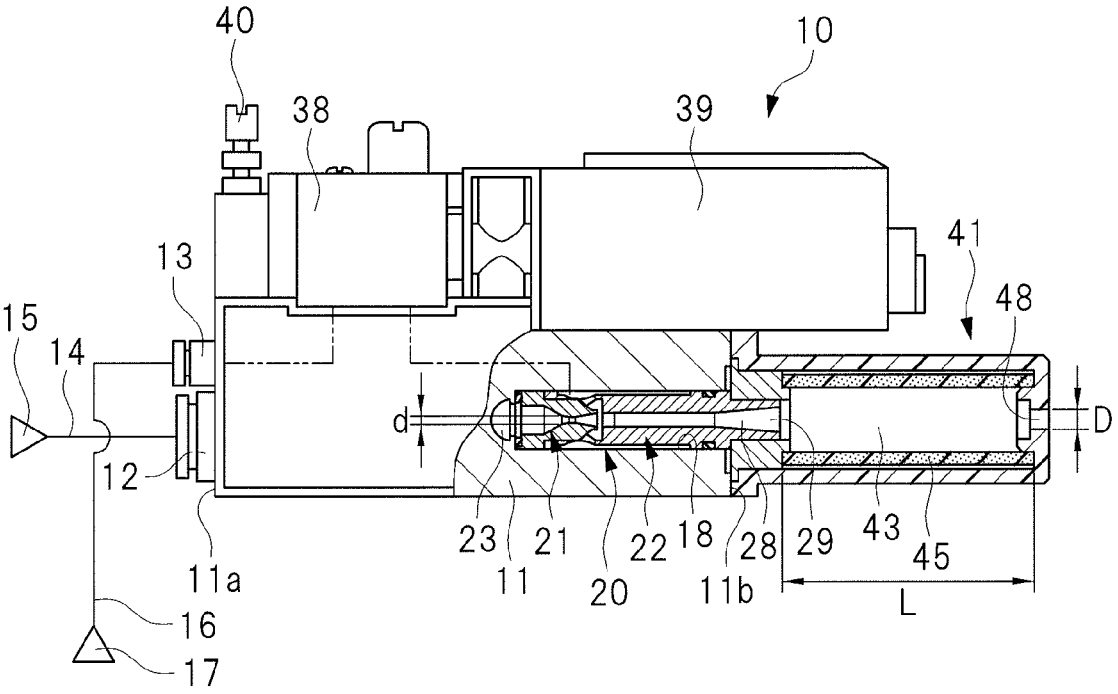
FIG. 2 is a partially cutaway front view of the ejector shown in FIG. 1.

Hereinafter, one embodiment of the present invention will be described in detail on the basis of the drawings. As shown in FIGS. 1 and 2, an ejector 10 has a rectangular parallelepiped ejector block 11. A positive-pressure joint 12 and a negative-pressure joint 13 are attached to one end face 11*a* of this ejector block 11. A positive-pressure piping 14 is detachably attached to the positive-pressure joint 12, and via this positive-pressure piping 14, the ejector 10 is connected to an air-pressure supply source 15 having a compressor and the like. A negative-pressure piping 16 is detachably attached to the negative-pressure joint 13, and an attracting tool 17 as a negative-pressure actuation apparatus for attracting electronic components is attached to this negative-pressure piping 16. Each of the positive-pressure piping 14 and the negative-pressure piping 16 is formed of a member such as flexible tube or rigid pipe, which is formed with a flow channel for guiding air.

Figure 3:
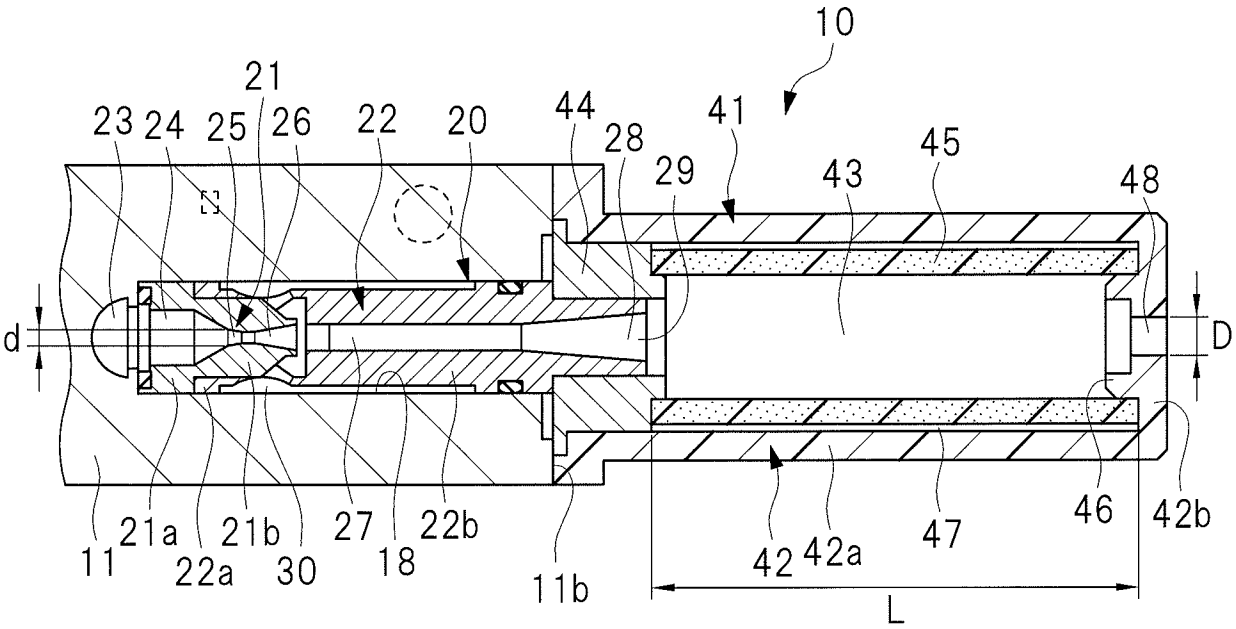
FIG. 3 is a partially enlarged sectional view of the ejector shown in FIG. 2.

The ejector block 11 is formed with an ejector housing hole 18. As shown in FIGS. 2 and 3, this ejector housing hole 18 is open on the other end face 11*b* of the ejector block 11, and is a bottomed hole. An ejector 20 is built in this ejector housing hole 18.

As shown in FIG. 3, this ejector 20 has a nozzle 21 which is disposed on the bottom side of the ejector housing hole, and a diffuser 22 which is disposed on the opening end side of the ejector housing hole in comparison with this nozzle 21. The nozzle 21 has a base portion 21 a which is fitted in the ejector housing hole 18, and a distal-end portion 21*b* having a smaller diameter than the base portion 21*a*. The base portion 21*a* is formed with an inflow hole 24 which communicates with an air supply portion 23 which is open on a bottom surface of the ejector housing hole 18, and the distal-end portion 21*b* is formed with: a focusing hole 25 which has a smaller diameter than the inflow hole 24 and which communicates with the inflow hole 24; and a diffusion hole 26 which communicates with the focusing hole 25 and which has an inner diameter which is gradually increased toward the distal-end face.

The diffuser 22 has: a base-end side suction portion 22*a* fitted onto the outer side of the distal-end portion 21*b* of the nozzle 21; and a distal-end side ejecting part 22*b*. The ejecting part 22*b* is formed with: a guiding hole 27 into which compressed air flows from the diffusion hole 26 of the nozzle 21; and a diffusion hole 28 which communicates with the guiding hole 27 and which has an inner diameter gradually increased toward the distal-end face, and the opening of the diffusion hole 28 serves as an ejecting port 29 for ejecting air. The suction portion 22*a* of the diffuser 22 is formed with a suction port 30 which communicates with a sucking space between the distal-end of the nozzle 21 and the guiding hole 27 of the diffuser 22. This suction port 30 communicates with the negative-pressure joint 13.

By supplying compressed air to the air supply port 23 from the air-pressure supply source 15, the compressed air passes through the focusing hole 25 of the nozzle 21 and is ejected toward the guiding hole 27 of the diffuser 22 from the diffusion hole 26. The air ejected from the diffusion hole 26 is mixed with air between the diffusion hole 26 and the guiding hole 27, that is, air of the suction port 30, and is ejected together with the mixed air from the diffusion hole 28 of the diffuser 22. As a result, negative-pressure air is supplied from the suction port 30 to the attracting tool 17 which is connected by the negative-pressure piping 16, and an electronic component such as a semiconductor chip can be attracted and carried by the attracting tool 17.

Figure 4:
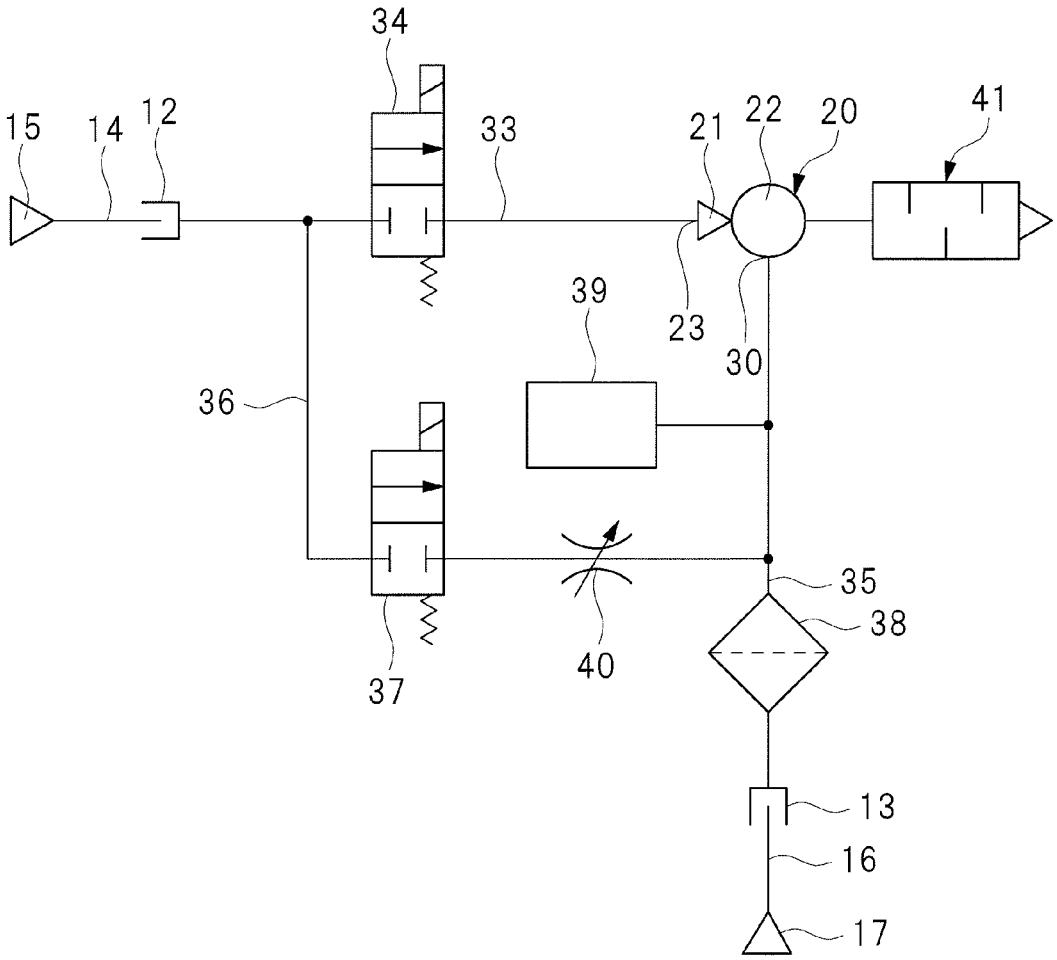
FIG. 4 is a pneumatic circuit diagram showing air flow in the ejector shown in FIG. 1.

As shown in FIG. 1, a solenoid valve block 31 and a joint block 32 are attached to an upper surface of the ejector block 11. The solenoid valve block 31 constitutes tandem 3-port valves and is provided with two 3-port valves. As shown in FIG. 4, one of the 3-port valves constitutes a vacuum generating control valve 34 for opening/closing a vacuum generating flow channel 33 between the positive-pressure joint 12 and the air supply port 23. The other of the 3-port valves constitutes a vacuum break control valve 37 for opening/closing a vacuum break flow channel 36 between the positive-pressure joint 12 and a vacuum flow channel 35 formed between the suction port 30 and the negative-pressure joint 13.

In order to remove foreign matters in air flowing through the negative-pressure piping 16 toward the suction port 30, as shown in FIGS. 1 and 2, a filter 38 is provided on the upper surface of the ejector block 11. In order to detect the vacuum degree of the vacuum flow channel 35, a pressure sensor 39 is provided on the upper surface of the ejector block 11. Furthermore, in order to adjust the flow rate of the compressed air for vacuum break supplied to the attracting tool 17 by the vacuum break flow channel 36, a throttle 40 is attached to the upper surface of the ejector block 11.

In order to reduce the exhaust noise caused by airflow which is ejected from the ejecting port 29 of the ejector 20, a muffler 41 is attached to the end face 11*b* of the ejector block 11. The muffler 41 has a muffler main body 42 which is composed of: a cylindrical portion 42*a* which is attached to the end face 11*b* of the ejector block 11 by, for example, screws; and a distal-end wall portion 42*b* which is integrated with a distal-end of the cylindrical portion 42*a*. The muffler main body 42 is formed with a silencing chamber 43. The distal-end portion of the diffuser 22 is projecting in the muffler main body 42, and a cylindrical holder 44 is attached to the distal-end portion of the diffuser 22.

A cylindrical silencing member 45 is disposed in the muffler main body 42, one end portion of the silencing member 45 is supported by the holder 44, and the other end of the silencing member 45 is supported by a projecting portion 46 provided to the distal-end wall portion 42*b*. The silencing member 45 is formed of material having air permeability such as porous material or fibrous material. A silencing gap 47 is provided between the silencing member 45 and the cylindrical portion 42*a*, and the exhaust noise permeated through the silencing member 45 is silenced by the silencing gap 47.

The distal-end wall portion 42*b* is formed with an exhaust opening 48 which faces the ejecting port 29 and is coaxially aligned with the ejecting port 29. The axial airflow of the center part of air ejected into the silencing chamber 43 from the ejecting port 29 of the diffuser 22 is discharged to the outside without any change from the exhaust opening 48. On the other hand, the diffusion airflow flown into the silencing chamber 43 from the ejecting port 29 and then diffused radially outward collides with the silencing member 45, and its noise is absorbed by the silencing member 45. The noise of the diffusion airflow permeated through the silencing member 45 is silenced by the silencing gap 47.

In order to attract an electronic component by the attracting tool 17, the ejector 10 for supplying negative-pressure air to the negative-pressure actuation apparatus such as the attracting tool 17 is required to supply negative-pressure air having the vacuum degree and flow rate necessary for attraction to the attracting tool 17. The ejector 10 is preferable to have not only the desired vacuum degree and intake flow rate but also low exhaust noise caused by air ejected from the ejecting port of the diffuser 22.

In a conventional muffler provided in an ejector, a silencing member is embedded in an exhaust flow channel for guiding, to an exhaust opening, air ejected from a diffuser. Such a conventional muffler has limitations for reducing exhaust noise while supplying, to the attracting tool, the negative-pressure air having the vacuum degree and flow rate necessary for attraction of an electronic component.

As shown in the drawings, by causing the exhaust opening 48 to face the ejecting port 29 of the diffuser 22, the axial airflow at the center part of the air ejected from the ejecting port 29 into the silencing chamber 43 is discharged to the outside without any change from the exhaust opening 48. It has been conventionally known that, when the airflow is discharged from the ejecting port 29 to the outside without changing its attitude (direction) in this manner, exhaust noise would be increased. However, it was found that, by discharging the center part of the straight airflow to the outside via the exhaust opening 48 and by diffusing the remaining air in the radially outward direction and then discharging it to the outside, the exhaust noise caused by the airflow discharged from the exhaust opening 48 to the outside can be reduced while ensuring the vacuum degree and the intake flow rate of the negative-pressure air. However, it was found that the inner diameter "D" of the exhaust opening 48 largely affects the vacuum degree and the flow rate of the generated negative-pressure air; and if the inner diameter "D" of the exhaust opening 48 is excessively small, the desired vacuum degree and the flow rate cannot be ensured.

Conditions under which the exhaust noise of the air discharged from the exhaust opening 48 can be reduced while obtaining desired values of the vacuum degree and the flow rate of the negative-pressure air to be supplied to the negative-pressure actuation apparatus such as the attracting tool 17 was found. In the ejector 10 used for attracting an electronic component such as semiconductor chip, the flow rate of the negative-pressure air supplied to the attracting tool 17 largely depends on a nozzle diameter "d" which is set by the inner diameter of the focusing hole 25 of the nozzle 21. When the nozzle diameter "d" is within a range of about 0.5 to 1.0 mm, a sufficient flow rate can be ensured for the negative-pressure air supplied to the negative-pressure actuation apparatus which is used in an assembly production line of electronic components.

Therefore, in three types which have nozzle diameters "d" of d=0.5 mm, d=0.7 mm, and d=1.0 mm, the vacuum degree and the intake flow rate of the negative-pressure air and the sound absorption performance were measured with the longitudinal size "L" of the silencing member 45 and the inner diameter "D" of the exhaust opening 48 being changed. An ejector having the nozzle diameter "d" of d=0.5 mm is referred to as "05 type", an ejector having the nozzle diameter "d" of d=0.7 mm is referred to as "07 type", and an ejector having the nozzle diameter "d" of d=1.0 mm is referred to as "10 type".

Figure 5A:
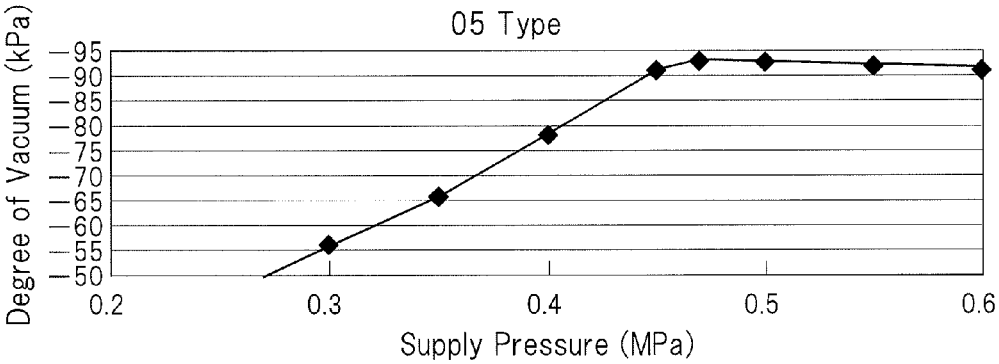
FIGS. 5A to 5C are characteristic diagrams of measurements of the relation between a supply pressure and the vacuum degree in three types including 05 type, 07 type, and 10 type, which was measured with the longitudinal size of a silencing member being changed.
Figure 5B:
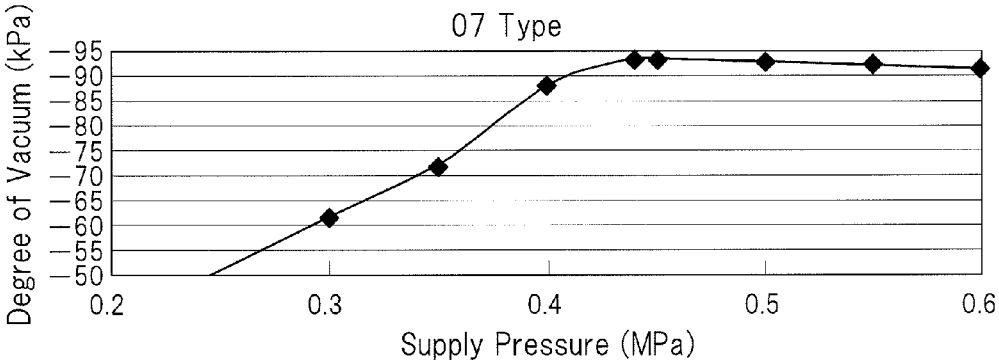
Figure 5C:
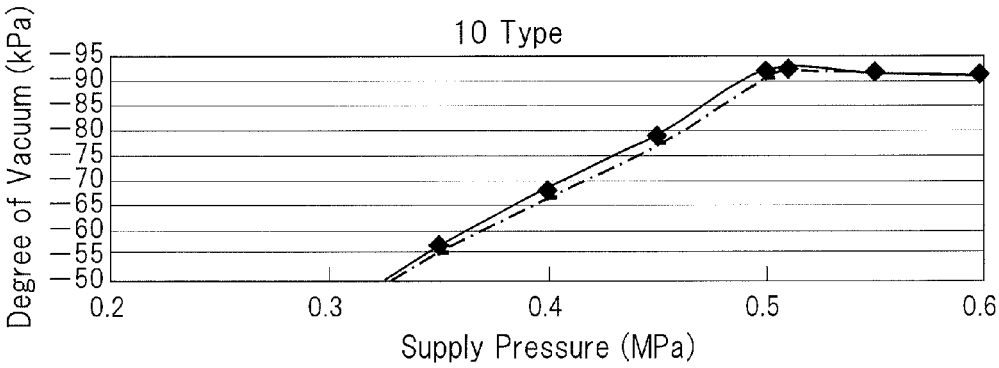

FIGS. 5A to 5C show measurements of the relation between the supply pressure and the vacuum degree in three types: 05, 07 and 10, which was measured with the longitudinal size "L" of the silencing member 45 being changed. The inner diameter "D" of the exhaust opening 48 of the ejectors 10 used in measurement is 3 mm. The term "supply pressure" is intended to indicate the pressure of the compressed air supplied to the air supply port 23, and "the vacuum degree" is intended to indicate the pressure of the negative-pressure air obtained by the ejector. As the longitudinal size "L" of the silencing member 45, measurement was carried out for eight types of: 11 mm, 16 mm, 21 mm, 26 mm, 31 mm, 36 mm, 41 mm, and 46 mm. Regarding the 05 type and the 07 type, as shown in FIGS. 5A and 5B, the relation between the supply pressure and the vacuum degree in the ejectors of the above-described eight types different from each other in length was similarly changed. Regarding the 10 type, only a slight difference was observed, and there was not a large difference in the vacuum degree even when the length "L" was changed. FIGS. 5A and 5B show measurements of the cases in which the longitudinal size "L" was 11 mm. In FIG. 5C, the case in which the longitudinal size "L" was 16 mm is shown by a solid line, and the case in which the size L was 41 mm is shown by a dashed-dotted line.

Figure 6A:
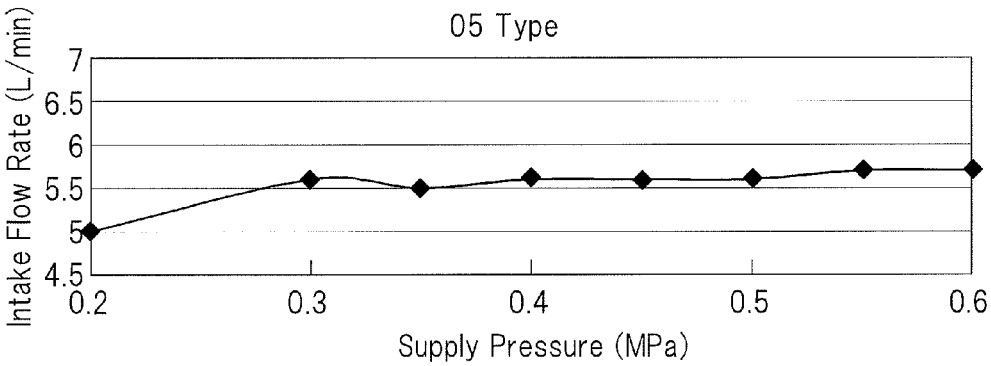
FIGS. 6A to 6C are characteristic diagrams of measurements of the relation between the supply pressure and an intake flow rate in three types, which was measured with the longitudinal size of the silencing member being changed.
Figure 6B:
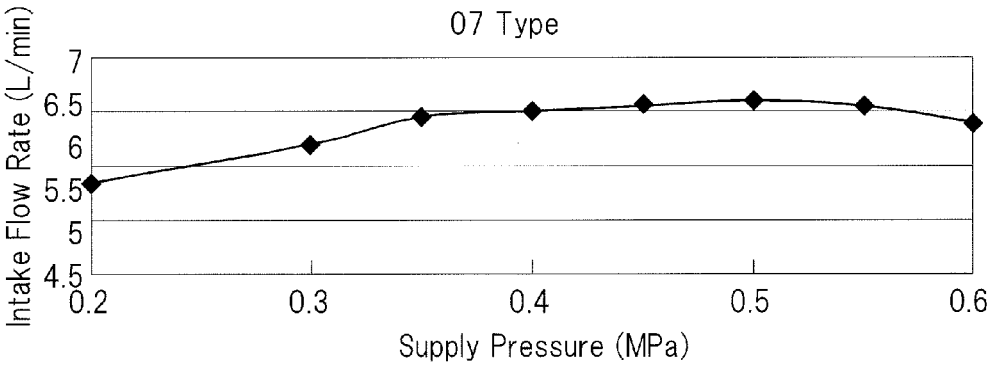
Figure 6C:
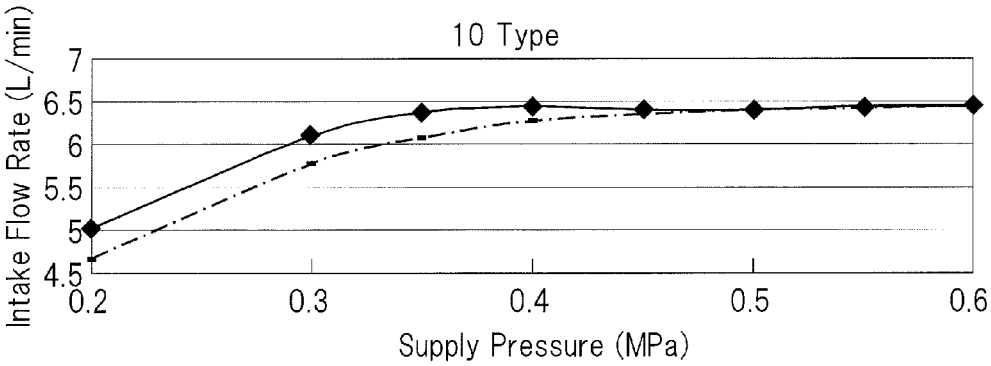

FIGS. 6A to 6C show measurements of the relation between the supply pressure and the intake flow rate in the above-mentioned three types, which was measured with the longitudinal size "L" of the silencing member 45 being changed. The inner diameter "D" of the exhaust opening 48 of the ejectors 10 used in the measurements is 3 mm. The term "intake flow rate" is intended to indicate the flow rate of air which flows into the attracting tool 17 by the negative pressure obtained by the ejector 10. Regarding the 05 type and the 07 type, FIGS. 6A and 6B show the measurements of the ejector having the size "L" of 11 mm, wherein the size "L" is the shortest; and even when other lengths were employed, the intake flow rate was not largely changed. Regarding the 10 type, in FIG. 6C, the ejector having the shortest size L=11 mm is shown by a solid line, and the ejector having the longest length L=46 mm is shown by a dashed-dotted line; and the ejector having the other size has the intake flow rate between them.

From FIGS. 5A to 6C, it was found that the longitudinal size "L" of the silencing member 45 corresponding to the longitudinal size of the muffler 41 does not largely affect the vacuum degree and the intake flow rate of the negative-pressure air to be obtained.

Figure 7A:
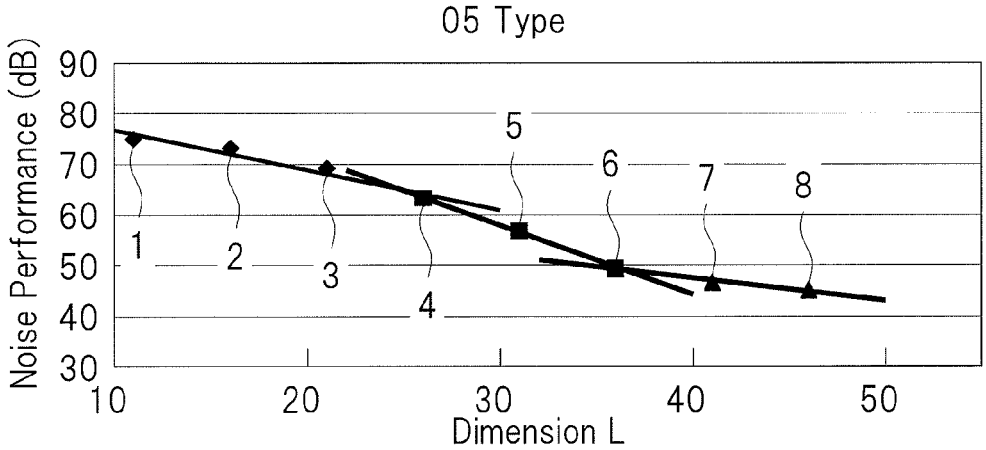
FIGS. 7A to 7C are characteristic diagrams of measurements of the relation between the longitudinal size of the silencing member and noise performance in three types.
Figure 7B:
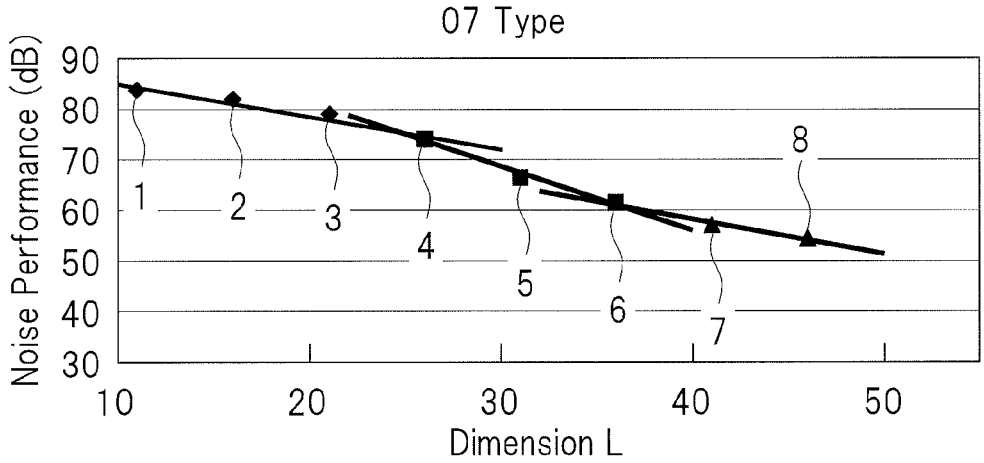
Figure 7C:
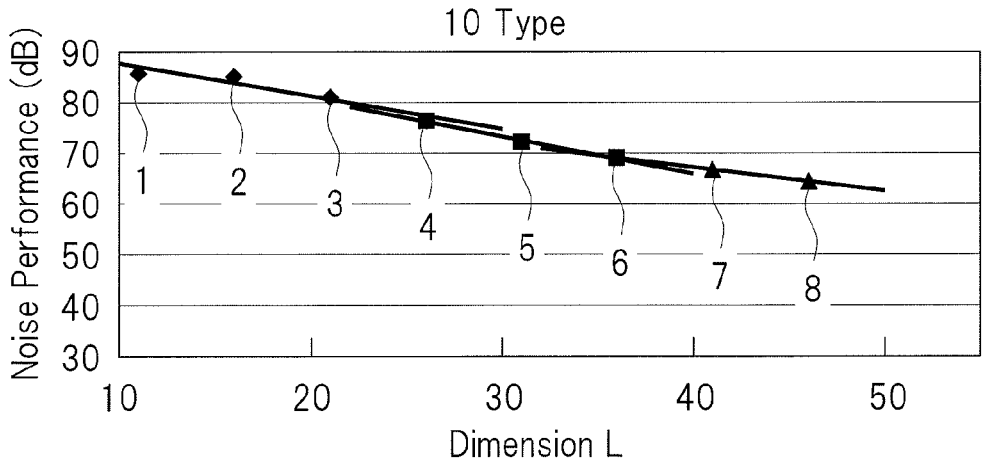

FIGS. 7A to 7C show measurements of the relation between the longitudinal size "L" of the silencing member 45 and the noise performance in the above three types. The inner diameter "D" of the exhaust opening 48 of the ejector 10 used in this measurement is 3 mm as well as the cases shown in FIGS. 5A to 6C. In FIGS. 7A to 7C, the above-described eight types are respectively shown by symbols 1 to 8, the size "L" of the ejector shown by the symbol 1 is 11 mm, and the sizes "L" of the ejectors of 2 to 8 are sequentially 16, 21, 26, 31, 36, 41, and 46 mm.

From these results, it was found that silencing performance is improved when the size "L" is increased; however, when the size "L" is set to 50 mm or higher, the ejector 10 is increased in size; and, when the size "L" is within the range of 20 to 50 mm, silencing performance can be ensured in all of the three types. As shown in FIGS. 7A and 7B, it has been found that, in the 05 type and the 07 type, the decreasing rate in noise is large when the size "L" is increased from 21 mm to 36 mm, and practically preferred silencing effects are obtained by setting the size "L" within the range of 20 to 50 mm. Particularly, by setting the size "L" within the range of 40 to 50 mm, the silencing effects can be improved more.

As shown in FIGS. 5 to 7, the sound absorption performance can be improved by making the longitudinal size "L" of the silencing member 45 larger; however, by making it excessively longer, the ejector 10 is increased in size. Therefore, it was found that, in the above three types, desired silencing performance can be ensured by setting the longitudinal size "L" within the range of 20 to 50 mm, and that their silencing effects can be improved more by setting it within the range of 40 to 50 mm. Furthermore, it was found that the longitudinal size "L" of the silencing member 45 does not largely affect the vacuum degree and the intake flow rate.

Figure 8A:
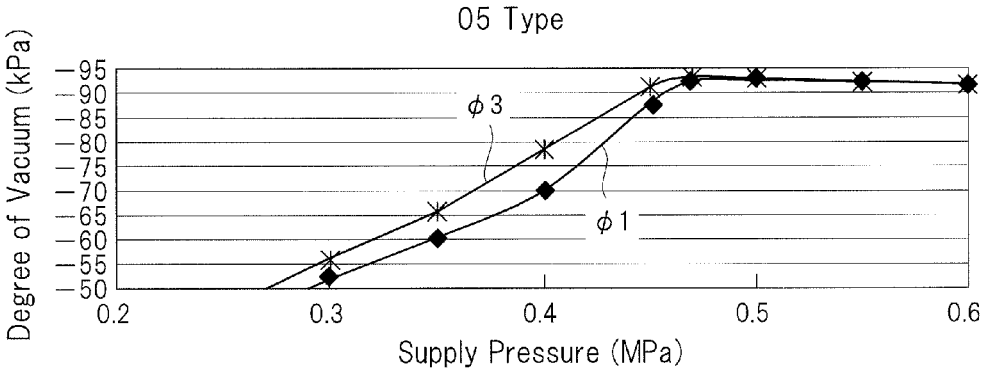
FIGS. 8A to 8C are characteristic diagrams of measurements of the relation between the supply pressure and the vacuum degree in three types, which was measured with the inner diameter of an exhaust opening being changed.
Figure 8B:
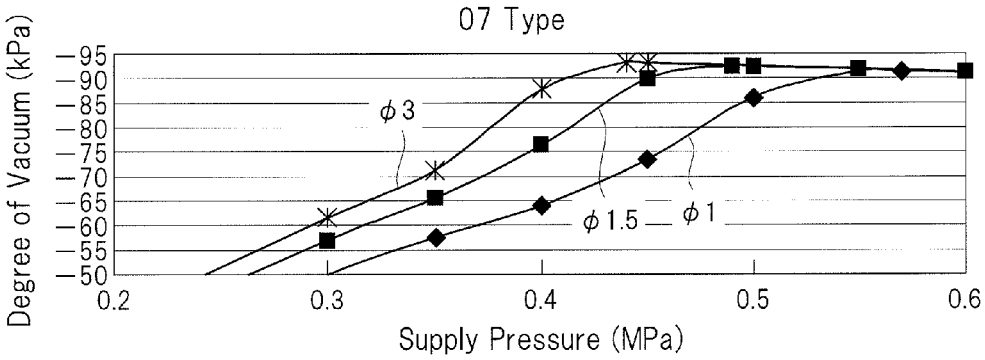
Figure 8C:
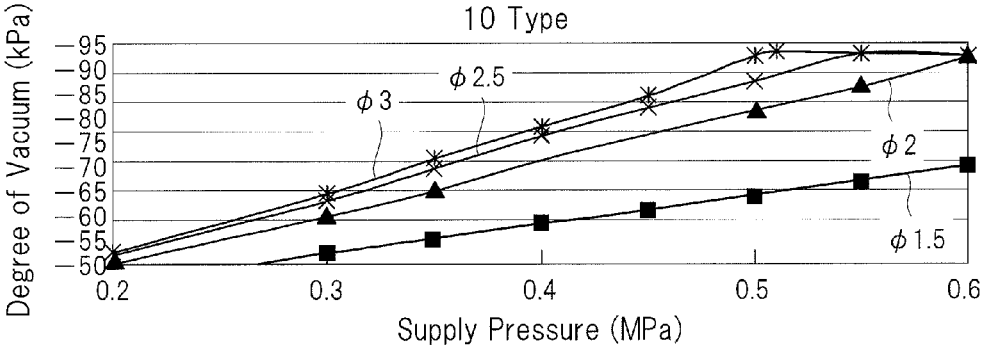

FIGS. 8A to 8C show measurements of the relation between the supply pressure and the vacuum degree in the above three types, which was measured with the inner diameter "D" of the exhaust opening 48 being changed. This measurement was carried out for five inner diameters "D": ϕ1, ϕ1.5, ϕ2, ϕ2.5, and ϕ3. FIG. 8A shows measurements for ϕ1 and ϕ3, and FIG. 8B shows measurements for ϕ1, ϕ1.5, and ϕ3. FIG. 8C shows measurements for ϕ1.5, ϕ2, ϕ2.5, and ϕ3.

From this measurement, it was found that the vacuum degree of the negative pressure obtained by the ejector is sufficient when the inner diameter "D" is equal to or larger than 1 mm in the 05 type, the inner diameter "D" is equal to or larger than 1.5 mm in the 07 type, and the inner diameter "D" is equal to or larger than 2 mm in the 10 type. Specifically, it was found that the necessary vacuum degree is obtained by setting the inner diameter "D" to two times equal to or larger than the nozzle inner diameter "d".

Figure 9A:
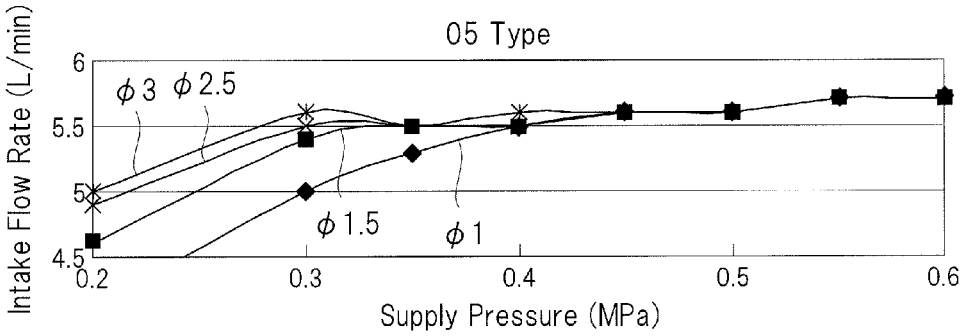
FIGS. 9A to 9C are characteristic diagrams of measurements of the relation between the supply pressure and the vacuum degree in three types, which was measured with the inner diameter of the exhaust opening being changed.
Figure 9B:
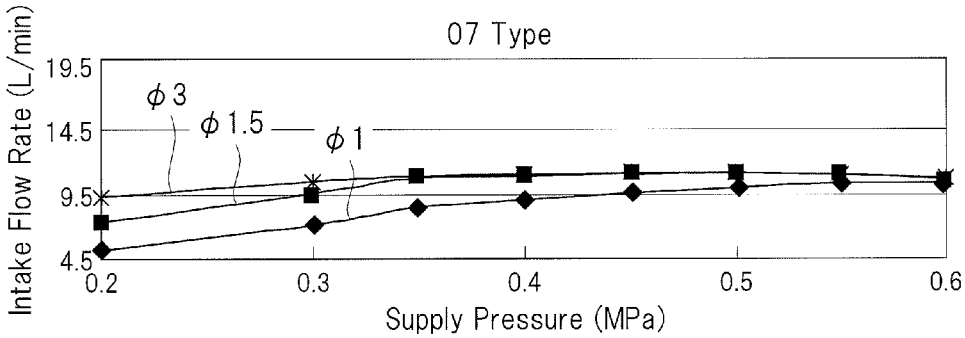
Figure 9C:
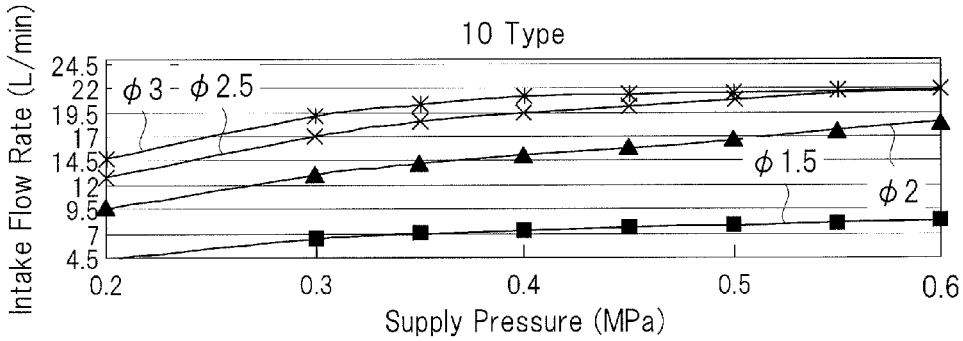

FIGS. 9A to 9C show measurements of the relation between the supply pressure and the intake flow rate in the above three types, which was measured with the inner diameter "D" of the exhaust opening 48 being changed. This measurement was carried out for five inner diameters "D": ϕ1, ϕ1.5, ϕ2, ϕ2.5, and ϕ3 as well as the measurements shown in FIGS. 8A to 8C. As shown in FIG. 9C, the insufficient intake flow rate was obtained when the inner diameter "D" was set to 1 mm in the 10 type; however, the sufficient intake flow rate was obtained when the inner diameter "D" was set to the other diameters. In the 05 and 07 types, the sufficient intake flow rate was obtained in each of the inner diameters "D".

From the measurements shown in FIGS. 8A and 9C, it was found that it is preferred that the inner diameter "D" of the exhaust opening 48 be set to two times equal to or larger than the nozzle inner diameter "d" in order to ensure the vacuum degree and the intake flow rate.

Figure 10A:
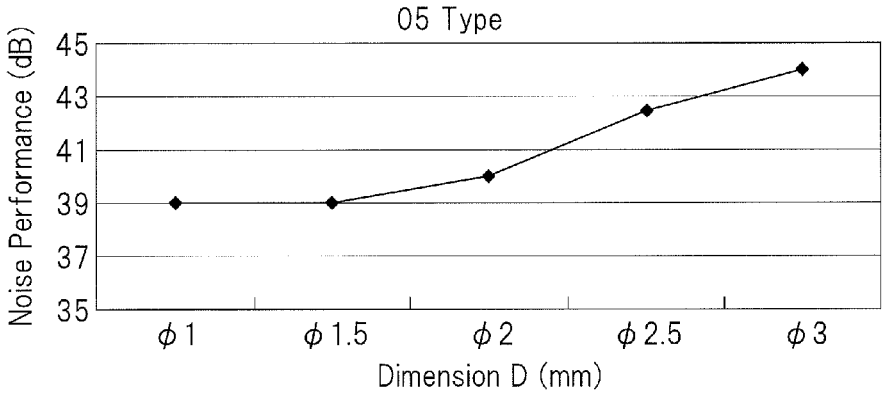
FIGS. 10A to 10C are characteristic diagrams of measurements of the relation between the inner diameter of the exhaust opening and the noise performance in three types.
Figure 10B:
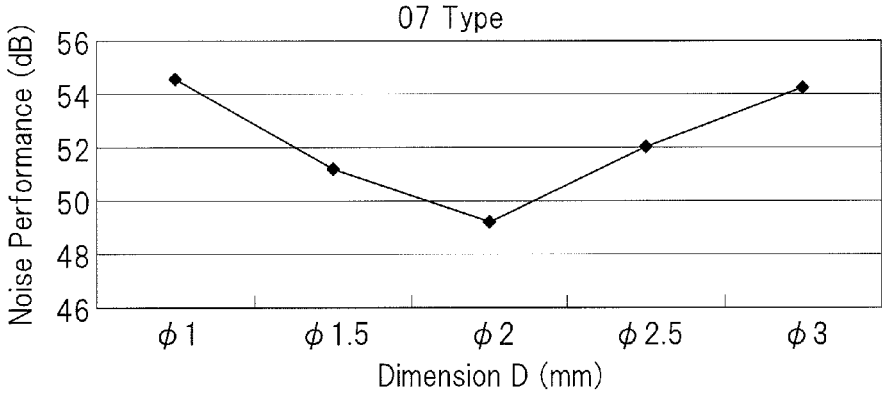
Figure 10C:
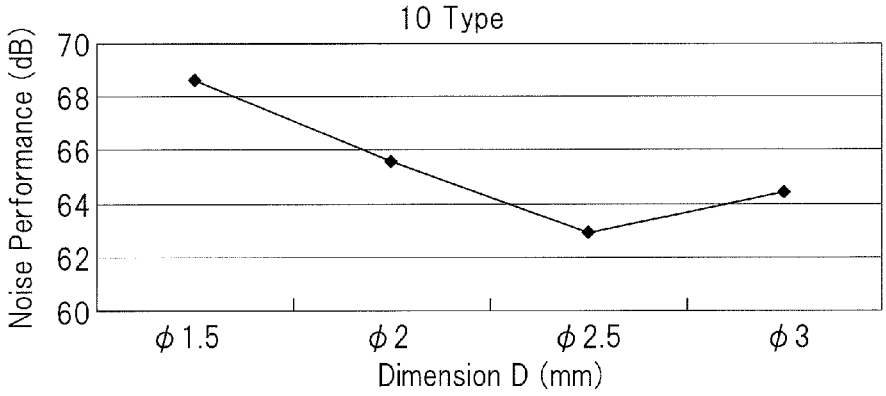

FIGS. 10A to 10C show measurements of the relation between the inner diameter "D" of the exhaust opening 48 and the noise performance in the above three types. From this measurement, it was found that, as shown in FIG. 10A, the sufficient silencing effect can be obtained when the inner diameter "D" is equal to or less than 2.5 mm, in other words, five times the nozzle inner diameter "d" or less than that in the 05 type. It was found that, as shown in FIG. 10B, the sufficient silencing effect can be obtained when the inner diameter "D" is within the range of 1.5 mm to 2.5 mm, in other words, within the range of about two to four times the nozzle inner diameter "d" in the 07 type. It was found that, as shown in FIG. 10C, the sufficient silencing effect can be obtained when the inner diameter "D" is within the range of 2.0 to 3.0 mm, in other words, is within the range of about two to three times the nozzle inner diameter "d" in the 10 type.

The present invention is not limited to the above-described embodiment, and various modifications can be made within a range not departing from the gist thereof. For example, the nozzle inner diameter is not limited to the above three types, and various diameters can be employed. The solenoid valve block 31, the filter 38, and other members are attached to the ejector block 11; however, these members may be disposed to be separated from the ejector block 11.

INDUSTRIAL APPLICABILITY

This ejector may be applied to an apparatus for attracting and carrying a small electronic component.

What is claimed is:

1. An ejector comprising:

an ejector block formed with an ejector housing hole which communicates with an air supply port at a base end thereof;

a nozzle housed in the ejector housing hole, the nozzle having: an inflow hole communicating with the air supply port; a focusing hole smaller in cross section size than the inflow hole and continuous from the inflow hole; and a diffusion hole continuous from the focusing hole and being gradually increased in cross section size toward a distal end of the nozzle;

a diffuser housed in the ejector housing hole and axially aligned with the nozzle, the diffuser and the distal end of the nozzle forming a sucking space which communicates with the diffusion hole, and communicates with the ejector housing hole via a suction port, the diffuser being formed with: a guiding hole communicating with the sucking space; and an ejecting port continuous from the guiding hole for discharging air ejected from the nozzle and air flowed from a suction port;

a muffler main body having a cylindrical portion covering the ejecting port and a distal-end wall portion integrally formed with one end of the cylindrical portion, the muffler main body is formed with a silencing chamber which communicates with the ejecting port;

a cylindrical hollow silencing member arranged in the cylindrical portion; and an exhaust opening provided so as to face the ejecting port at the distal-end wall portion, the exhaust opening having a longitudinal axis coaxially aligned with a longitudinal axis of the ejecting port.

2. The ejector according to claim 1, wherein a silencing gap is formed between the silencing member and an inner circumferential surface of the cylindrical portion.

3. The ejector according to claim 1, wherein the nozzle is within the range of 0.5 to 1.0 mm in inner diameter, and the silencing member is within the range of 20 to 50 mm in length.

4. The ejector according to claim 1, wherein the nozzle is within the range of 0.5 to 1.0 mm in inner diameter, and the exhaust opening is within the range of two to four times of the nozzle in inner diameter.

5. The ejector according to claim 2, wherein the nozzle is within the range of 0.5 to 1.0 mm in inner diameter, and the silencing member is within the range of 20 to 50 mm in length.

6. The ejector according to claim 2, wherein the nozzle is within the range of 0.5 to 1.0 mm in inner diameter, and the exhaust opening is within the range of two to four times of the nozzle in inner diameter.

7. An ejector comprising:

an ejector block formed with an ejector housing hole which communicates with an air supply port at a base end thereof;

a nozzle housed in the ejector housing hole, the nozzle having: an inflow hole communicating with the air supply port; a focusing hole smaller in cross section size than the inflow hole and continuous from the inflow hole; and a diffusion hole continuous from the focusing hole and being gradually increased in cross section size toward a distal end of the nozzle;

a diffuser housed in the ejector housing hole and axially aligned with the nozzle, the diffuser and the distal end of the nozzle forming a sucking space which communicates with a vacuum flow channel formed in the ejector block, the diffuser being formed with: a guiding hole communicating with the sucking space; and an ejecting port continuous from the guiding hole, for discharging air ejected from the nozzle and air flowed from the vacuum flow channel;

a muffler main body having a cylindrical portion covering the ejecting port and a distal-end wall portion integrally formed with one end of the cylindrical portion, the muffler main body is formed with a silencing chamber which communicates with the ejecting port;

a cylindrical hollow silencing member arranged in the cylindrical portion; and an exhaust opening provided so as to face the ejecting port at the distal-end wall portion the exhaust opening having a longitudinal axis coaxially aligned with a longitudinal axis of the ejecting port.

* * * * *